US010933517B2

(12) United States Patent
Gringer et al.

(10) Patent No.: US 10,933,517 B2
(45) Date of Patent: Mar. 2, 2021

(54) KNIFE WITH SCREWDRIVER BIT

(71) Applicant: ALLWAY TOOLS, INC., West Babylon, NY (US)

(72) Inventors: Donald Gringer, New York, NY (US); Yuan Fang Cheng, Syosset, NY (US)

(73) Assignee: ALLWAY TOOLS, INC., West Babylon, NY (US)

( * ) Notice: Subject to any disclaimer, the term of this patent is extended or adjusted under 35 U.S.C. 154(b) by 128 days.

(21) Appl. No.: 16/059,795

(22) Filed: Aug. 9, 2018

(65) Prior Publication Data

US 2019/0054599 A1 Feb. 21, 2019

Related U.S. Application Data

(60) Provisional application No. 62/545,783, filed on Aug. 15, 2017.

(51) Int. Cl.

| | |
|---|---|
| ***B25B 15/02*** | (2006.01) |
| ***B25B 23/00*** | (2006.01) |
| ***E04F 21/32*** | (2006.01) |
| ***E04F 21/06*** | (2006.01) |
| ***B25F 1/04*** | (2006.01) |
| ***B25F 1/00*** | (2006.01) |
| ***E04F 21/16*** | (2006.01) |

(52) U.S. Cl.

CPC ..... *B25B 15/02* (2013.01); *B25B 23/0007* (2013.01); *B25F 1/006* (2013.01); *B25F 1/04* (2013.01); *E04F 21/06* (2013.01); *E04F 21/161* (2013.01); *E04F 21/32* (2013.01)

(58) Field of Classification Search

CPC .... B25B 23/0007; E04F 21/06; E04F 21/161; E04F 21/32

USPC ..... 7/165, 105; 30/162

See application file for complete search history.

(56) References Cited

U.S. PATENT DOCUMENTS

| | | | | | |
|---|---|---|---|---|---|
| 180,187 | A * | 7/1876 | Bartlett | B44D 3/162 | 7/105 |
| 825,063 | A * | 7/1906 | Hebner | B44D 3/162 | 7/105 |
| 1,597,464 | A * | 8/1926 | Hebner | B25F 1/02 | 7/105 |
| 5,894,624 | A * | 4/1999 | Fulenwider | A46B 7/023 | 15/105 |
| 6,954,958 | B2 * | 10/2005 | Stubbs | B25F 1/04 | 30/169 |
| 7,069,828 | B2 * | 7/2006 | Huang | B25G 1/063 | 81/177.4 |
| 7,340,836 | B2 * | 3/2008 | Whitemiller | B23D 49/14 | 30/152 |

* cited by examiner

*Primary Examiner* — Hadi Shakeri

(74) *Attorney, Agent, or Firm* — Gottlieb, Rackman & Reisman, PC

(57) ABSTRACT

A knife that includes a blade, a handle affixed to an end of the blade and a screwdriver bit fixed to the handle and moveable between an extended position beyond the base of the handle and a retracted position in which the screwdriver bit is arranged completely within the opening of the handle.

15 Claims, 10 Drawing Sheets

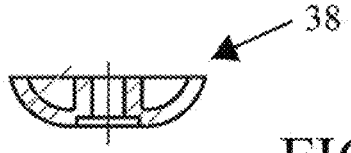
FIG. 13
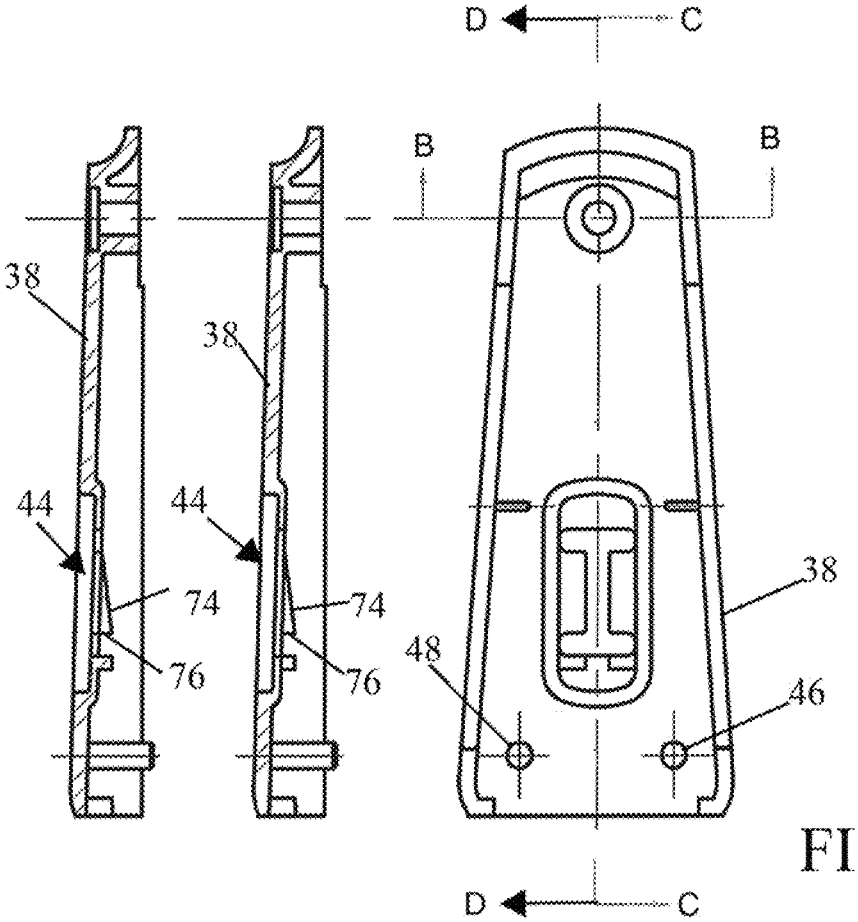
FIG. 11
FIG. 15 FIG. 14
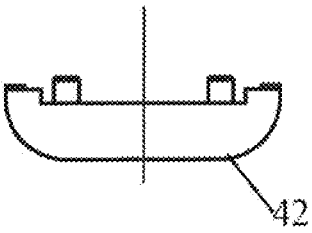
FIG. 12

KNIFE WITH SCREWDRIVER BIT

CROSS-REFERENCE TO RELATED APPLICATION

This patent application claims benefit under 35 U.S.C. § 120 to U.S. Provisional Patent Application No. 62/545,783, filed Aug. 15, 2017, which is hereby incorporated by reference in its entirety as part of the present disclosure.

FIELD OF THE INVENTION

The present invention generally relates to taping, joint and putty knives and more specifically to a tape, joint or putty knife that includes a screwdriver head releasably fixable thereto and arrangeable therein.

BACKGROUND OF THE INVENTION

Until the 1950's all taping, joint or putty knives and wider blade broad knives were made with hard wooden handles, similar to butcher and bread knives. In 1939, DuPont invented Nylon. Over time 90% of handles that had been machined in wood were molded in Nylon. The Nylon handles were injection molded and offered a significant cost savings over wood.

The building industry also began to change from plaster walls and ceilings to sheet rock (drywall) construction. To secure sheet rock to a surface, the sheets had to be initially nailed to wood studs and the joints between the sheets had to be plastered over with joint compound, taped, and a second or third coat of compound had to be applied to smooth the joint before sanding and painting. If a nail protruded above the surface, it would be tapped back into the stud with a hammer or the back of the tape knife (usually made of die cast metal).

Today nails are rarely used to secure sheet rock in place. Instead, screws (typically Phillips-head screws) are driven through sheet rock and into studs (e.g., wood or metal studding). In some instances, screw heads protrude above the surface wall panel. In order to prevent an unsightly bump does not remain, the screw must be driven into and slightly below the surface before spreading compound over the screw to create a uniformly smooth surface. If an individual is affixing sheet rock to a stud and does not have a screwdriver nearby, the individual must search for one. In many instances, the individual is on a ladder or a platform that is elevated from the floor, requiring him or her to leave the ladder or platform and search for a screwdriver. This requires time and results in the job taking longer to complete which, for professionals, can add up to result in lost earnings.

SUMMARY OF THE INVENTION

The present invention is generally directed to a taping, joint, broad or putty knife that includes a built-in screwdriver.

In an embodiment, the knife includes a blade and a handle that includes an opening extending therein and a screwdriver bit that is releasably fixed within the opening and in communication with a slidable button on the handle so that the screwdriver bit can be extended out of the opening and used when desired and the button can be depressed such that the screwdriver bit can return into the handle. In an embodiment, the handle can include a hammer end to aid in driving a raised nail head into the surface, if needed. The knife is thus designed for multiple uses allowing a user an efficient means to address multiple tasks.

BRIEF DESCRIPTIONS OF THE DRAWINGS

FIG. 11 is another rear view of a first handle portion of the knife of FIG. 1;

FIG. 12 is a first sectional view of the end cap of the handle of the knife of FIG. 1;

FIG. 13 is a sectional view of the first handle portion taken along line B-B is of FIG. 11;

FIG. 14 is a sectional view of the first handle portion taken along line C-C is of FIG. 11;

FIG. 15 is a sectional view of the first handle portion taken along line D-D is of FIG. 11;

DETAILED DESCRIPTION OF EMBODIMENTS OF THE INVENTION

Figure 1:
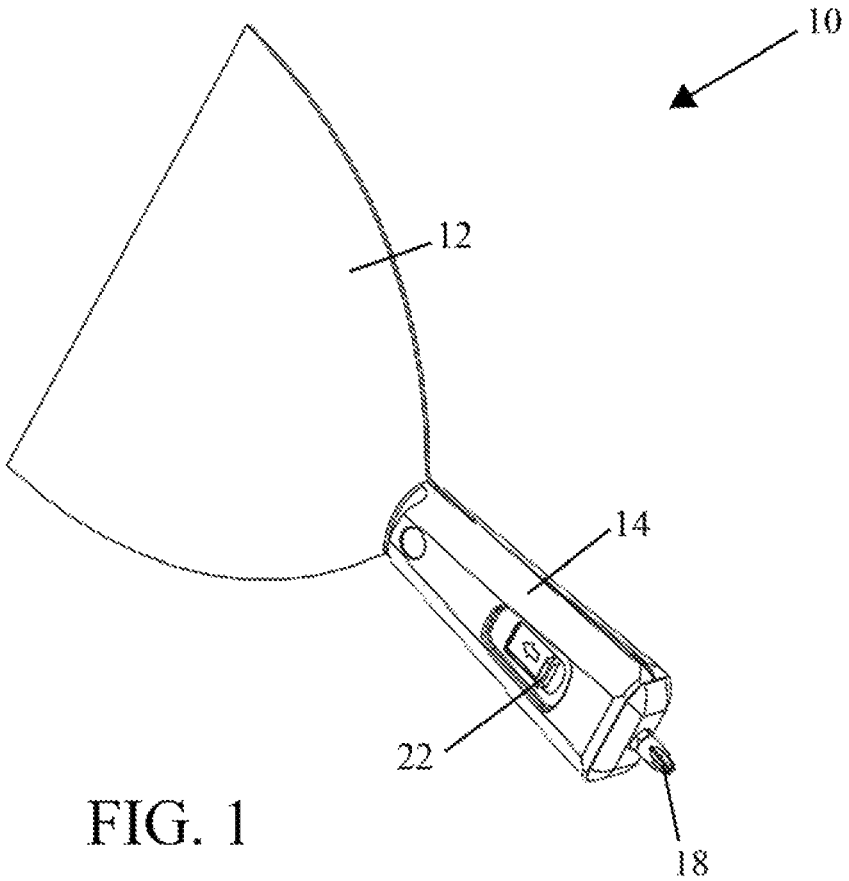
FIG. 1 is a perspective of an embodiment of a taping, joint, broad or putty knife that includes a screwdriver bit shown in an extended position.

With reference now to the drawings, and in particular to FIGS. 1 through 23, embodiments of a taping, joint or putty knife of the present disclosure, which is generally designated by the reference numeral 10, will be described.

Figure 2:
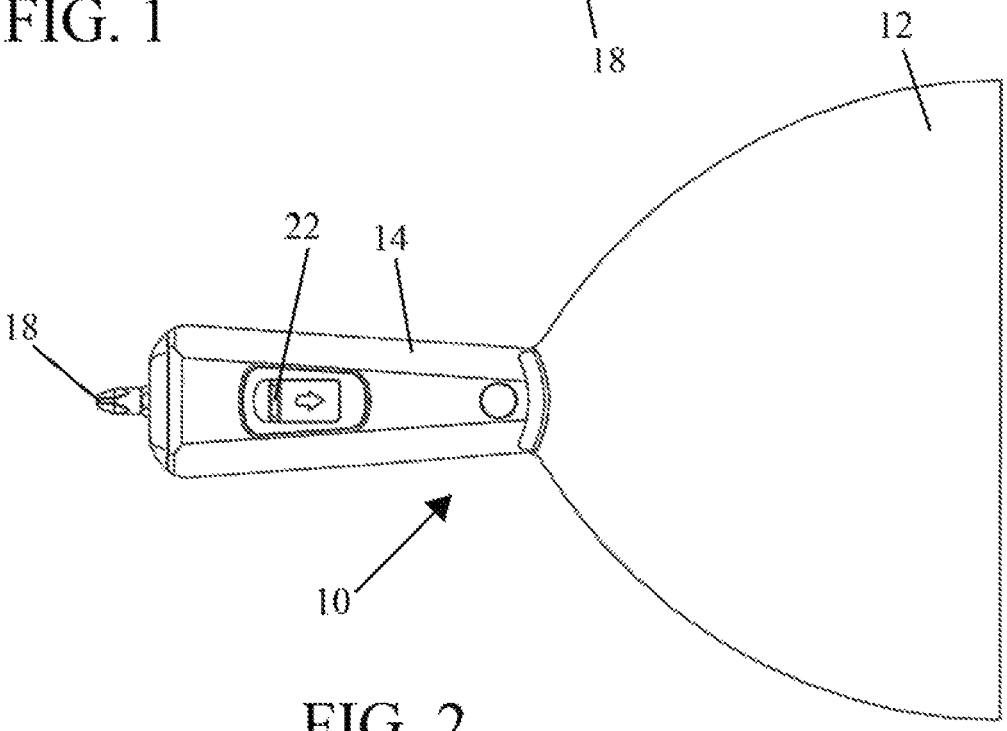
FIG. 2 is a front view of the knife of FIG. 1 with the screwdriver bit shown in an extended position.
Figure 3:
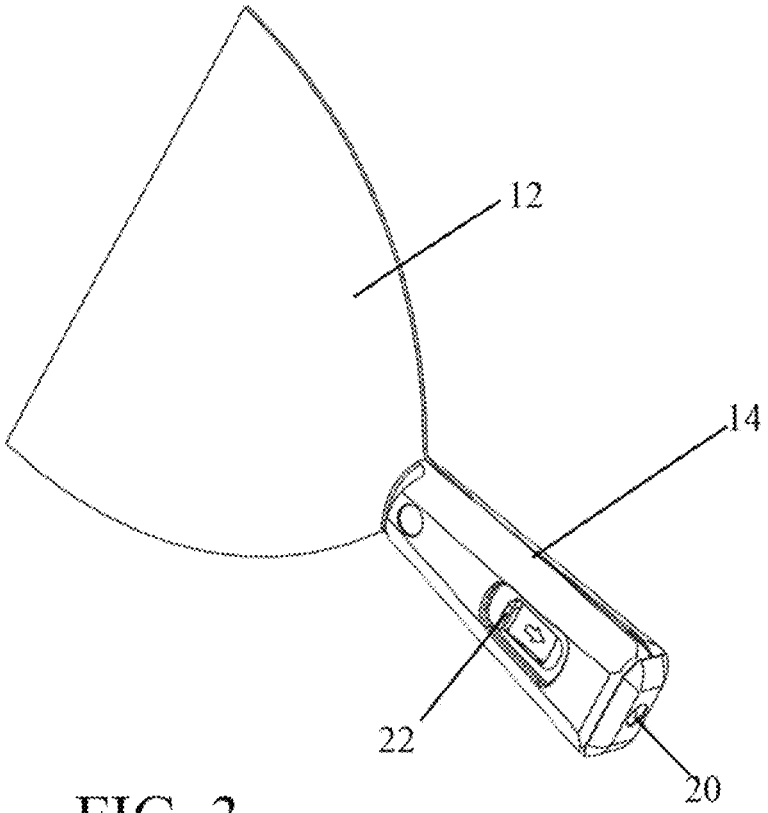
FIG. 3 is a perspective of the knife of FIG. 1 with the screwdriver bit shown in a retracted position such that the screw driver bit is not visible from the knife handle.
Figure 4:
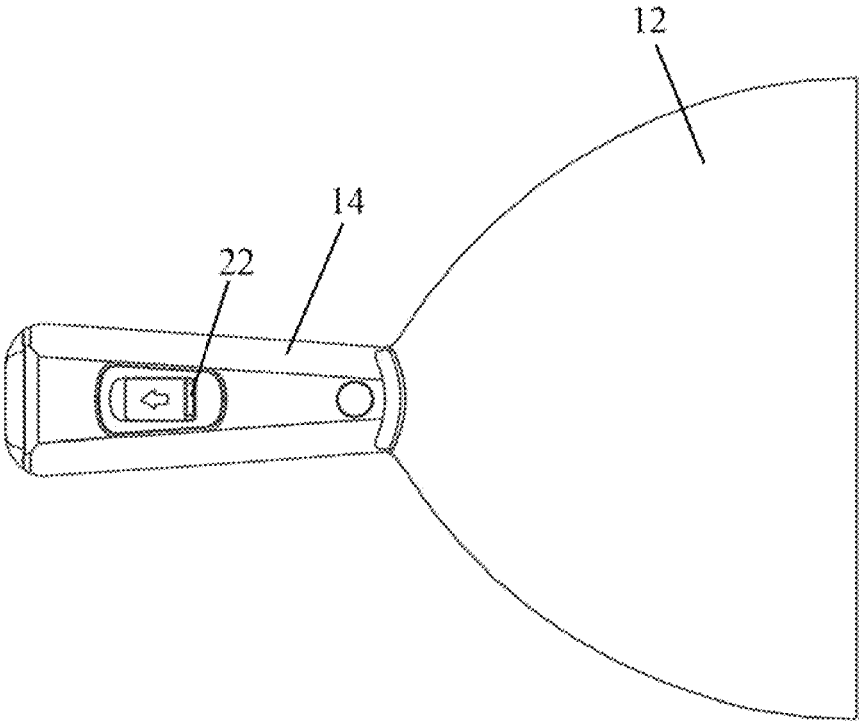
FIG. 4 is a side view of the knife of FIG. 1 with the screwdriver bit shown in the retracted position.
Figure 5:
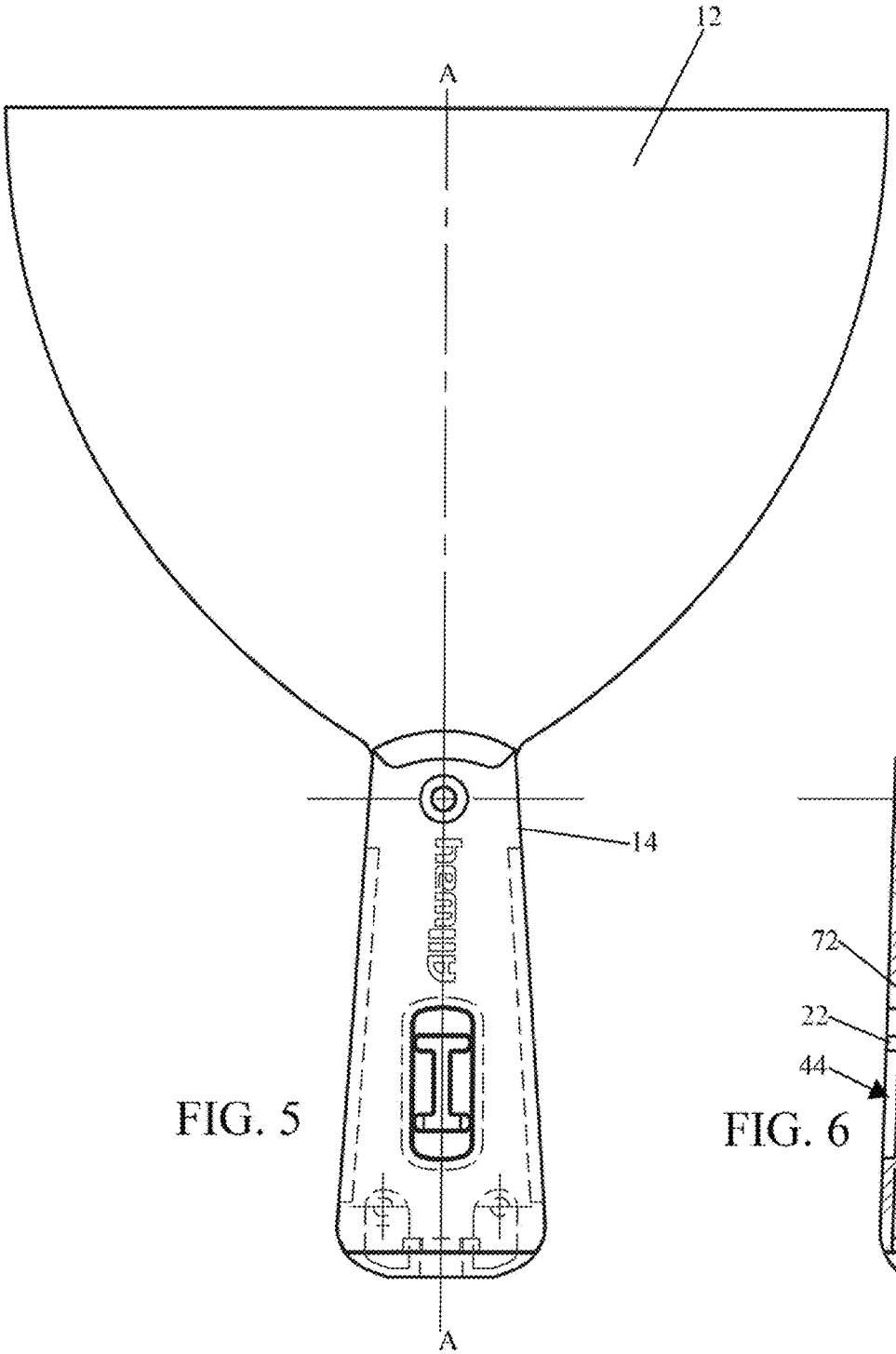
FIG. 5 is a front view of the knife of FIG. 1 that includes features shown partially in cross-section.
Figure 6:
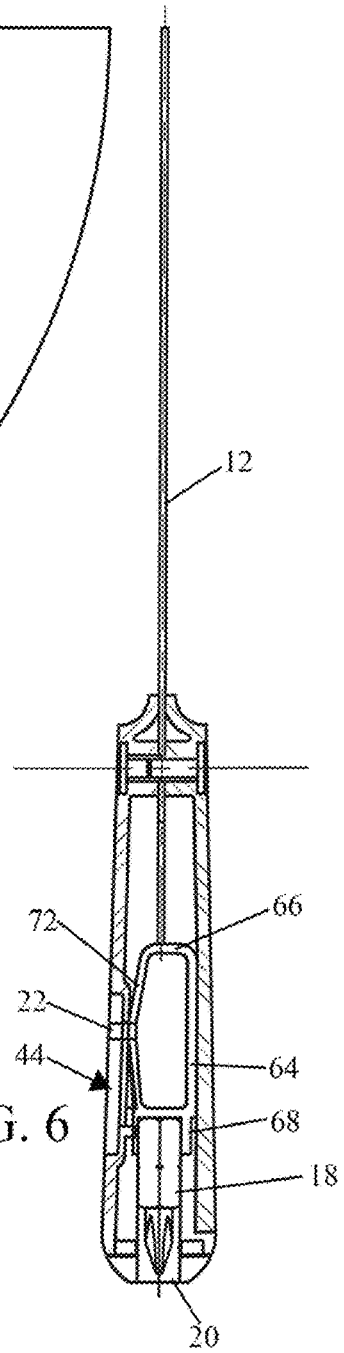
FIG. 6 is a cross-sectional view taken along line A-A of FIG. 5.

FIGS. 1-6 illustrate an embodiment of the knife 10 (e.g., a broad blade knife that is three to ten inches wide). The knife 10 generally includes a blade 12, a handle 14 and a screwdriver bit 18 (e.g., Phillips standard No. 2 bit) that is fixed along a central axis A-A (see FIG. 5) of the knife 10 within an opening 20 in the handle 14. A button or switch 22 is slideably fixed to the handle 14 and configured to aid in extending the screwdriver bit 18 beyond the opening 20 in the handle 14 as shown in FIGS. 1 and 2 and retracting the screwdriver bit 18 into the opening 20 in the handle 14 from an extended position as shown in FIGS. 3, 4 and 6. As shown in FIG. 6, in a retracted state, the screwdriver bit 18 is arranged within and spaced from an end of the handle 14.

As indicated above, to secure sheet rock to a surface, an individual must fasten the sheet rock of material to the surface, regularly with screws, applying tape between the sheets and skim coating plaster over the screw holes and tape to obtain a uniform surface. In many instances, a screw driver is needed to drive the screws fully into the wall. However, this requires the individual to locate a screw driver and place the knife down to address the screw condition. To avoid the use of multiple tools and reduce the overall time required to complete the overall job, using the knife 10 of the present disclosure, an individual can simply depress a button on the handle of the knife 10 and the screw driver bit 18 will extend from the handle 14 allowing the individual to merely move their hand 14 to address the screw condition and the continue applying and smoothing plaster on the surface.

Figure 9:
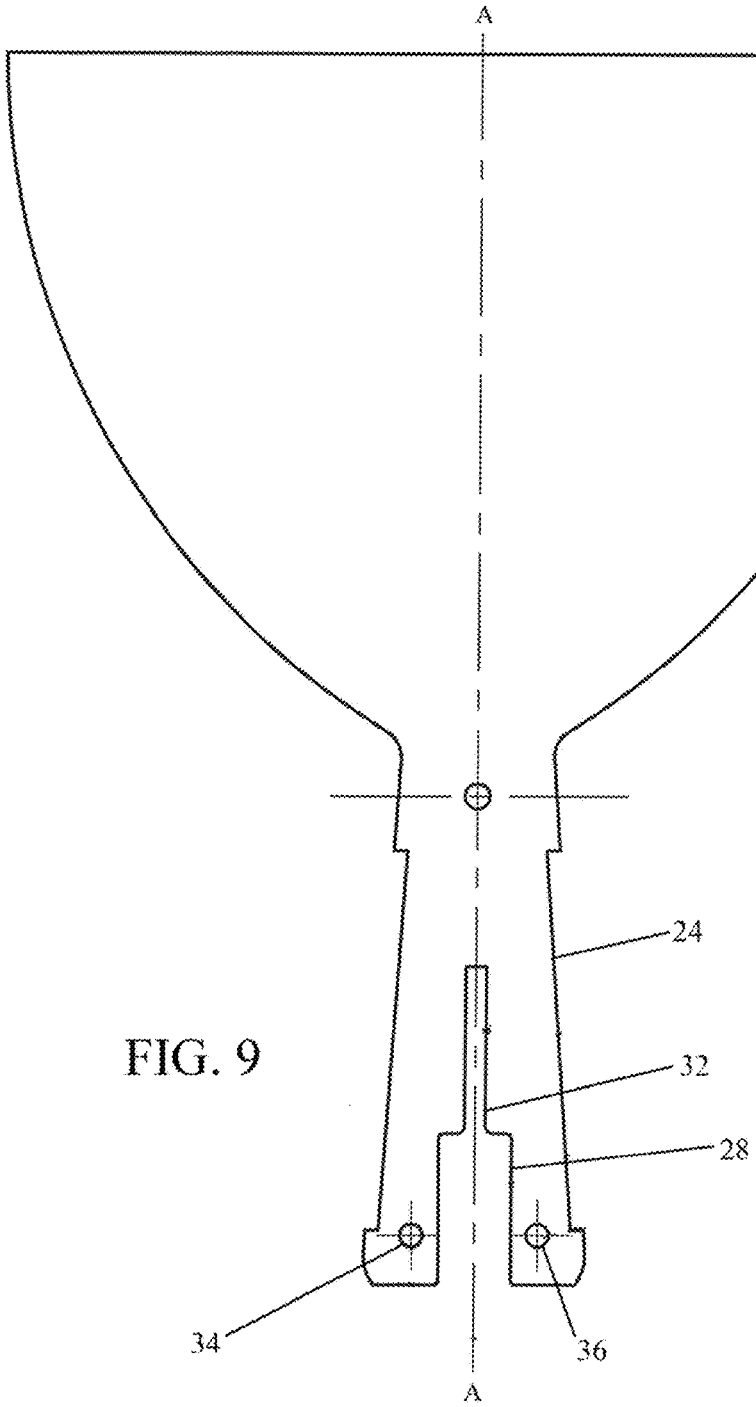
FIG. 9 is a front view of the blade and handle features of the knife of FIG. 1.
Figure 10:
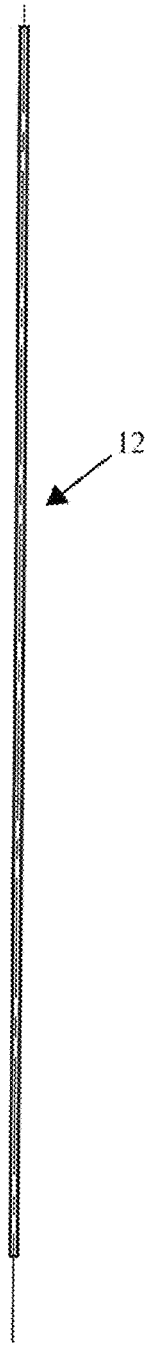
FIG. 10 is a side view of FIG. 9.
Figure 17:
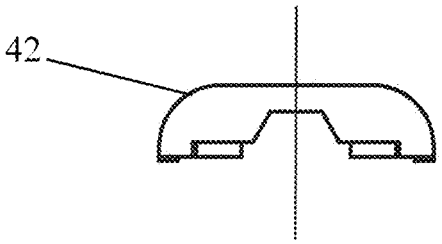
FIG. 17 is a second sectional view of the end cap of the handle of the knife of FIG. 1.
Figure 16:
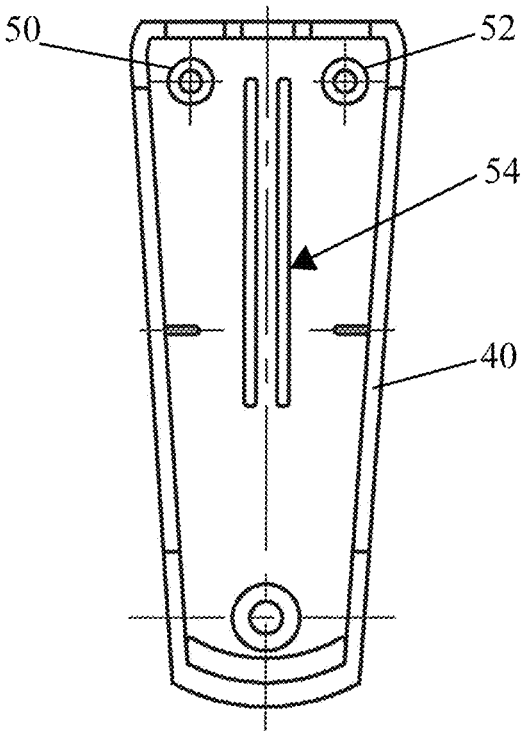
FIG. 16 is a front view of a second handle portion of the knife of FIG. 1.
Figure 18:
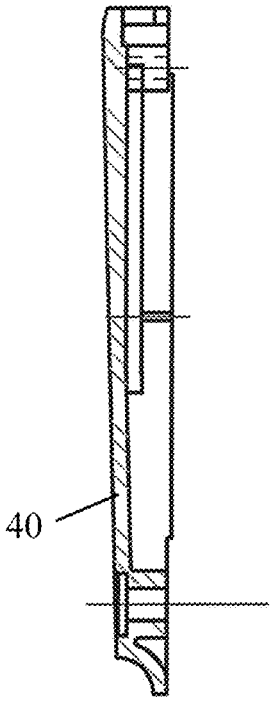
FIG. 18 is a cross-sectional side view of the second handle portion of the knife of FIG. 1.
Figure 19:
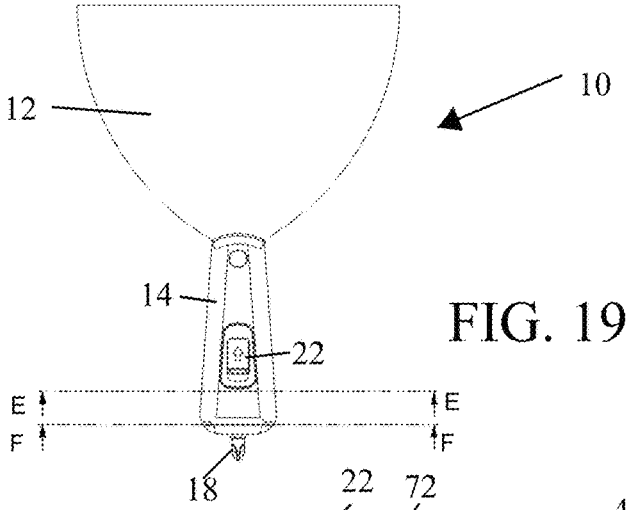
FIG. 19 is a front view of the knife of FIG. 1.

As illustrated in FIGS. 9-10, the blade 12 is comprised of a tang 24 and a head 28 that extends from the tang 24. The tang 24 includes a groove 30 that extends from a base 31 (see FIG. 7) of the tang 24 towards the head 28, a channel 32 that extends from the groove 30 toward the head 28, a first hole 34 and a second hole 36.

As depicted in FIGS. 7-8B and 11-18, the handle 14 is comprised of a first handle portion 38, a second handle portion 40 and an end cap or hammer end 42 that together at least substantially encompass the body 24 of the blade 12.

The first handle portion 38 includes a first pin 46 and a second pin 48 that extend therefrom that can aid in fixing the first handle portion 38 to the tang 24 and second handle portion 40, a recessed opening 44 in which at least the button 22 is arranged, a ramp 74 that that extends from the body of the first handle portion 38 and slopes outwardly from a top end of the first handle portion 38 toward the bottom end thereof and has a first stop 76 that delimits the ramp 74 and a second stop 77 that delimits the travel path of the holder 60 toward the top end of the handle 14. The second handle portion 40 includes a first pot-shaped projection 50 and a second pot-shaped projection 52 that extend from the second handle portion 40, a stop 79 that is a mirror image of the second stop 77 of the first handle portion and in combination with the second stop 77 delimits the travel path of the holder 60 and tracks 54. The opening 20 extends through the end cap or hammer end 42 and, when the screwdriver bit 18 is in a retracted state, the end cap or hammer end 42 can be used to drive a fastener into a surface.

The handle portions 38, 40 can be secured to each other and the tang 24 of the blade 12 by fasteners 56, 58 (e.g., cutlery rivets, screws, etc.), sonically welding together, and/or fastened together by other means (e.g., adhered together). In the case of sonic welding, the first pin 46 extends through the first opening 34 in the tang 24 of the blade 12 and into the first pot-shaped projection 50 and the second pin 48 extends through the second opening 36 in the tang 24 of the blade 12 and into the second pot-shaped projection 52.

In an embodiment, the first handle portion 38, the second handle portion 40 and the end cap 42 that comprise the handle 14 can be comprised of two-piece Nylon or a durable plastic. In an embodiment, the end cap or hammer end 42 can be comprised of die cast zinc or stamped steel.

Figure 7:
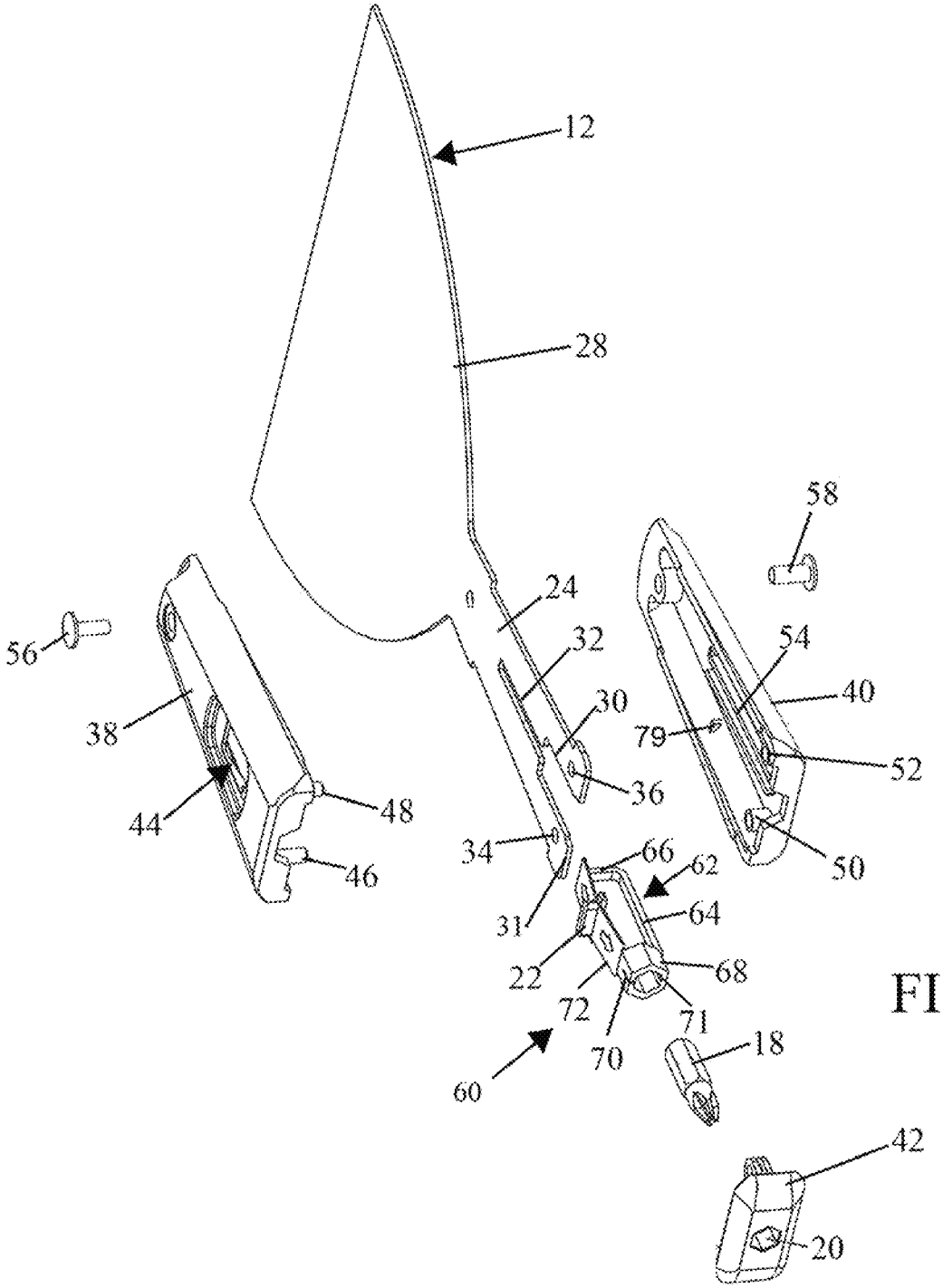
FIG. 7 is an exploded view of the knife of FIG. 1.
Figure 8A:
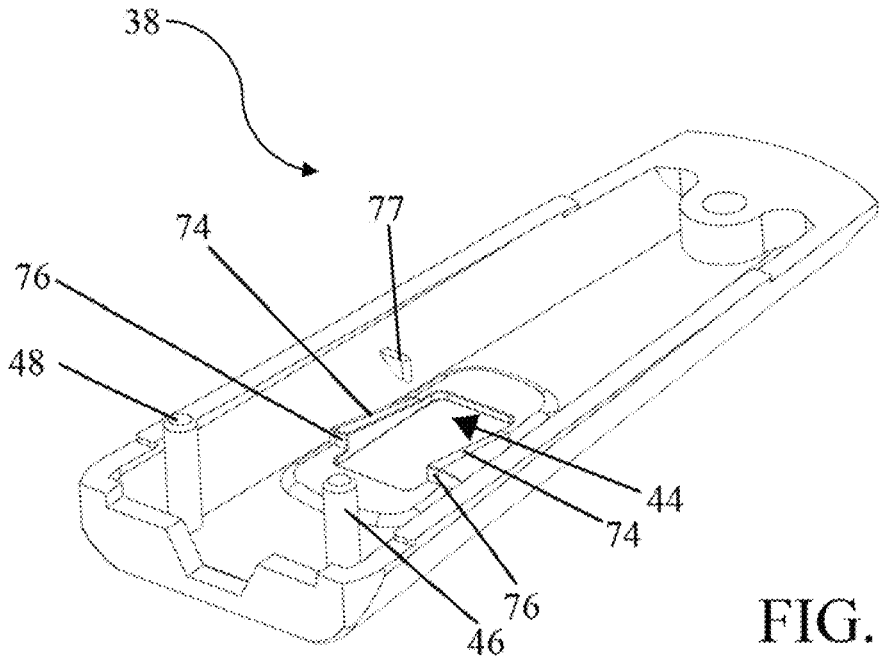
FIG. 8A is a perspective view of the first handle portion of the knife handle.
Figure 8B:
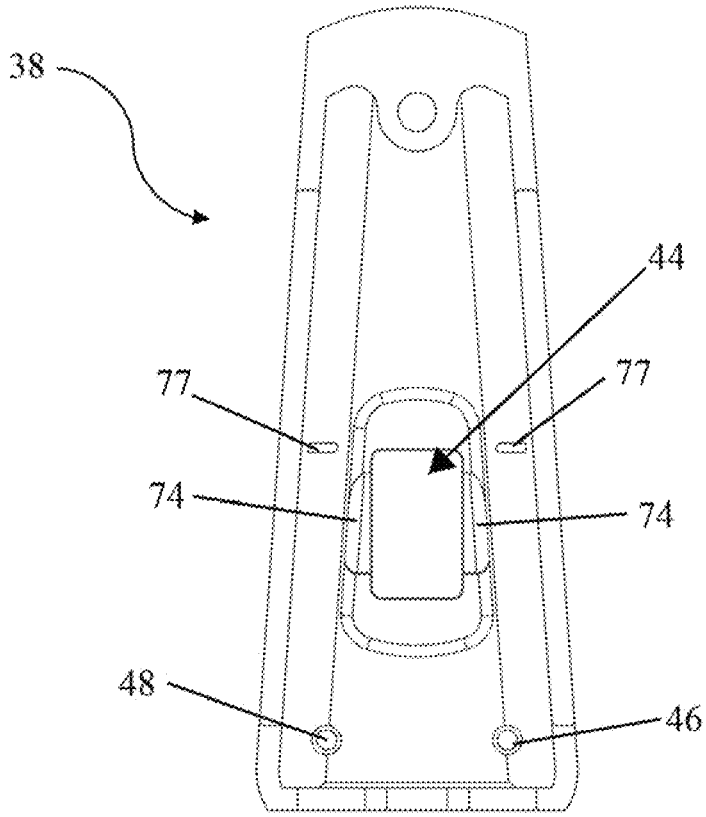
FIG. 8B is a rear view of the first handle portion of the knife handle.

Arranged within the handle 14 and slideable within the groove 30 and channel 32 of the tang 24 is a holder 60 (see FIG. 7). The holder 60, which can be, for example, comprised of a plastic or metal or a combination thereof, includes a rib 62 that is comprised of a first sidewall 64 and a second sidewall 66 that extends at an angle from the first sidewall 64, a receptor 68 that has slots 70, 71 which extends therein to allow for elastic deformation to receive the screwdriver bit 18 and releasably secure the screwdriver bit therein and an elastically deformable plate 72 to which the button 22 is affixed and that is spaced from the first sidewall 64 and extends between the receptor 68 and the second sidewall 66. The receptor 68 can be, for example, hexagonal in shape. However, the receptor 68 can take the form of any shape that can receive a screwdriver bit.

In an embodiment, the holder 60 can be made of a strong, springy material such as Delrin or Celcon to maintain a preload in an assembled state. However, the holder 60 can alternatively be made of any material that may be known or become known in the future.

Figure 20:
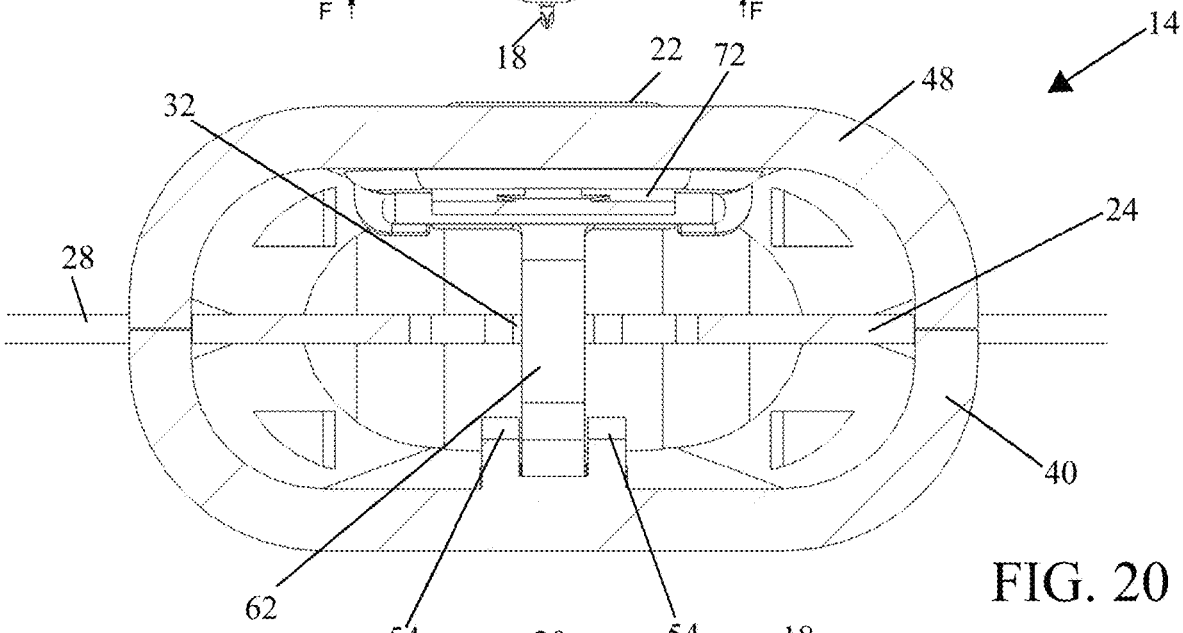
FIGS. 20 and 21 are cross-sectional views of the end of the knife taken along line E-E and line F-F, respectively, of FIG. 19.
Figure 21:
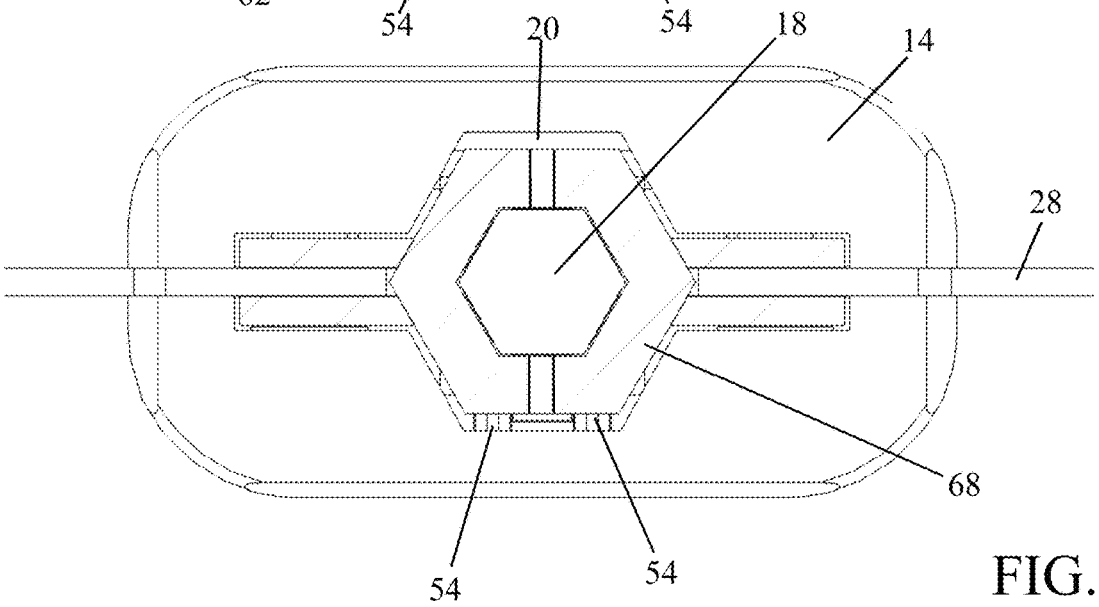

FIGS. 20-23 illustrate cross-sectional views of various aspects of the knife 10. FIGS. 20 and 21 are cross-sectional views of the knife 10 as viewed from portion of the handle 14 toward the blade 12 (see FIG. 19) with FIG. 20 showing the screwdriver bit 18 in a retracted state and FIG. 21 showing the screwdriver bit 18 in an extended state. As can be seen, the holder 60, which includes the receptor 68, is slideable along the ramp 74 and the track 54 via the rib 62 and within the channel 32 of the tang 24 along the central axis A-A.

Figure 22:
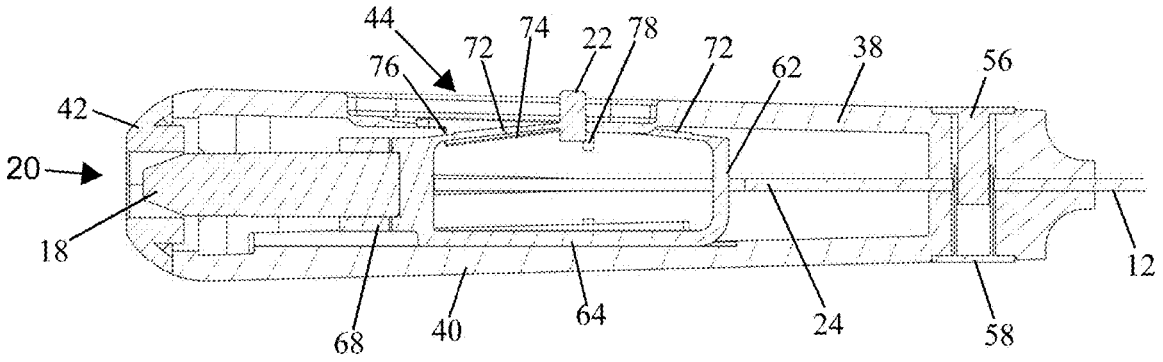
FIG. 22 is a cross-sectional view of the screwdriver handle and bit in a retracted state.
Figure 23:
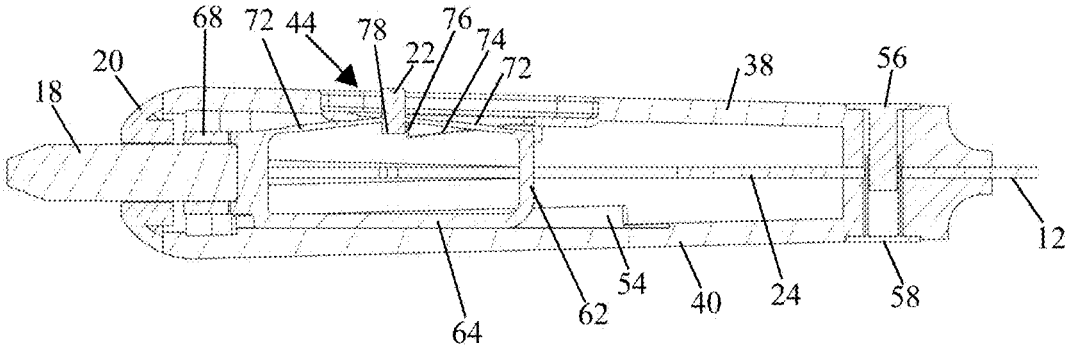
FIG. 23 is a cross-sectional view of the screwdriver handle and bit in an extended state.

FIG. 22 is a cross-sectional view showing the knife 10 with the screwdriver bit 18 in a retracted state. FIG. 23 is a cross-sectional view showing the screwdriver bit 18 in an extended state. The holder 60 includes a tab 78 that extends from the plate 72, opposite the button 22 and toward the second handle portion 40 when the handle 14 is in an assembled state. In an assembled state, the holder 60 is pre-loaded to maintain a retracted position and ensure the screwdriver bit 18 does not extend outwardly from the handle 14 unless desired.

In order for the screwdriver bit 18 to extend out of the handle 14, an individual must apply pressure to the button 22 of the holder 60 in a direction toward the end of the handle 14. The pressure will simultaneously cause the tab 78 to slide along the ramp 74 in conjunction with the plate 72, which can become elastically deformed as it slides along the ramp 74, while the holder 60 is slid along the track 54 toward the end of the handle 14. Upon reaching the end of the ramp 74, the tab 78 will contact the stop 76 and the holder 60 will lock in the extended state such that no further pressure is required to ensure the screwdriver bit 18 remains in an extended state.

When desired for the screwdriver bit 18 to be retracted within the handle 14, the button 20 is depressed, causing the plate 72 to elastically deform, releasing the tab 78 from contact with the stop 76. While applying pressure to the button 22, the holder 60 is slid about the central axis A-A, along the ramp 74 and toward the blade 12 of the knife 10. Once the tab 78 of the holder 60 is slid past the ramp 74 and pressure on the button 22 is released the screwdriver bit 18 will remain in the retracted state due to the pre-load on the holder 60.

The accompanying drawings illustrate an embodiment of a knife with a screwdriver bit and its respective constituent parts, however, other types and styles are possible, and the drawings are not intended to be limiting in that regard. Thus, although the description above and accompanying drawings contains much specificity, the details provided should not be construed as limiting the scope of the embodiment, but merely as providing illustrations of some of the features of the embodiment. The drawings and the description are not to be taken as restrictive on the scope of the embodiment and are understood as broad and general teachings in accordance with the present invention. While the present embodiment has been described using specific terms, such description is for illustrative purposes only, and it is to be understood that modifications and variations to such embodiment, including, but not limited to, the substitutions of equivalent features, materials, or parts, and the reversal of various features thereof, may be practiced by those of ordinary skill in the art without departing from the spirit and scope of the invention.

What is claimed is:

1. A broad knife for applying material to a surface, comprising:

a blade;

a handle affixed to an end of the blade and including an opening extending therein;

a holder that is arranged within the handle and that includes a body that has a receptor, and a screwdriver bit fixed within the receptor of the handle and configured to slide within the opening of the handle and extend outwardly beyond the opening of the handle, wherein the holder includes an elastically deformable plate and a projection that extends from the elastically deformable plate that is configured to aid in extending the screwdriver bit beyond the opening of the handle and retracting the screwdriver bit within the handle, and wherein the handle includes at least one ramp about which the holder is slideable that extends at an increasing angle from an interior surface of the handle toward the opening of the handle such that the at least one ramp has a stop to lock the holder when the screwdriver bit is in a fully extended state beyond the opening of the handle.

2. The broad knife of claim 1, wherein the body of the holder includes a first leg delimited at a first end and a second end that is contiguous at the first end thereof to the receptor and a second leg delimited at a first end and a second end that is contiguous at the first end thereof to the second end of the first leg and contiguous at the second end thereof to the plate.

3. The broad knife of claim 1, wherein the receptor includes at least one slot to allow for elastic deformation to aid in receiving the screwdriver bit and releasably securing the screwdriver bit therein.

4. The broad knife of claim 1, wherein the blade includes a tang and a head that extends from the tang.

5. The broad knife of claim 4, wherein the tang is delimited at a first end and a second end and the head extends from the first end of the tang, a groove extends from the second end of the tang toward the head and a channel extends from the groove toward the head.

6. The broad knife of claim 1, wherein the handle includes a recessed opening in which the projection extends through and is slidable within to allow for extension and retraction of the screwdriver bit.

7. The broad knife of claim 1, wherein the handle is comprised of a first handle portion and a second handle portion that together in an assembled state define an interior space in which the screwdriver bit is arranged.

8. The broad knife of claim 7, wherein the second handle portion includes a pair of projections that extend parallel to each other.

9. The broad knife of claim 1, wherein the handle includes an end configured to aid in driving a raised nail head into the surface.

10. The broad knife of claim 1, wherein the opening has an axis bisecting the knife and the screwdriver bit slides along the axis.

11. The broad knife of claim 1, further comprising a projecting extending from the handle, the projection operationally engaged to the screwdriver bit.

12. The broad knife of claim 1, wherein the screwdriver bit is a Phillips-head bit.

13. A method of using a broad knife, comprising the steps of:

providing the broad knife of claim 1;

applying pressure to the projection in a first direction toward the opening of the handle such that the plate is elastically deformed and the holder slides within the handle about and up the ramp toward the opening to allow the screwdriver bit to protrude out of the handle with the stop locking the holder upon reaching the end of the ramp; and when desired, applying pressure upon the projection in a second direction, away from the opening of the handle, to release the holder from the stop and permitting the holder to slide within the handle, away from the opening, to allow the screwdriver bit to be retracted within the handle.

14. The method of claim 13, wherein the handle includes a first handle portion that has an exterior surface, an interior surface, an opening extending through the exterior surface and interior surface and the ramp extending from the interior surface and a second handle portion that has an exterior surface, an interior surface thereof and a pair of tracks extending from the interior surface with the ramp and tracks facing each other, the holder arranged between the tracks and the projection of the holder extending through the opening such that upon pressuring being applied to the projection in at least one of the first direction and the second direction, the holder slides in one of the first direction to allow the screwdriver bit to extend beyond the handle and the second direction to allow the screwdriver bit to be retracted within the handle.

15. The method of claim 13, wherein the blade includes a tang that is delimited at a first end and a second end and the head extends from the first end of the tang, a groove extends from the second end of the tang toward the head and a channel extends from the groove toward the head and further comprising the step of sliding the holder along in one of the first direction and the second direction, within the channel of the blade.

* * * * *